US010953964B2

(12) United States Patent
O'Rourke

(10) Patent No.: US 10,953,964 B2
(45) Date of Patent: Mar. 23, 2021

(54) TANGLE-FREE RESCUE ASSIST DEVICE

(71) Applicant: John J. O'Rourke, Marshalls Creek, PA (US)

(72) Inventor: John J. O'Rourke, Marshalls Creek, PA (US)

( * ) Notice: Subject to any disclaimer, the term of this patent is extended or adjusted under 35 U.S.C. 154(b) by 0 days.

(21) Appl. No.: 16/826,362

(22) Filed: Mar. 23, 2020

(65) Prior Publication Data

US 2020/0307748 A1 Oct. 1, 2020

Related U.S. Application Data

(60) Provisional application No. 62/823,037, filed on Mar. 25, 2019.

(51) Int. Cl.
*B63C 9/08* (2006.01)
*B63C 9/22* (2006.01)

(52) U.S. Cl.
CPC ..... *B63C 9/082* (2013.01); *B63C 9/22* (2013.01)

(58) Field of Classification Search
CPC .. B63C 9/00; B63C 9/08; B63C 9/082; B63C 9/22; B63C 9/26
USPC ..... 441/80, 81, 82, 83, 84, 88, 125
See application file for complete search history.

(56) References Cited

U.S. PATENT DOCUMENTS 1,935,229 A * 11/1933 Neal ..... B63C 9/26 441/8
2,342,868 A * 2/1944 King ..... B63C 9/26 441/81
3,033,360 A * 5/1962 Ledoux ..... B63C 9/26 242/171
3,907,236 A * 9/1975 Sims, Jr. ..... A45F 5/00 242/404.1
4,713,033 A * 12/1987 Cameron ..... B63C 9/26 206/388
5,813,891 A * 9/1998 McNamee ..... B63C 9/081 441/108
6,629,867 B1 * 10/2003 Smith ..... B63C 9/22 441/81
6,659,823 B1 * 12/2003 Mosna ..... B63C 9/26 441/84
7,004,807 B1 * 2/2006 Summers ..... B63C 9/22 441/81
7,128,629 B2 * 10/2006 Summers ..... B63C 9/22 441/81

(Continued)

*Primary Examiner* — Daniel V Venne
(74) *Attorney, Agent, or Firm* — Woods Oviatt Gilman LLP; Dennis B. Danella, Esq.

(57) ABSTRACT

A rescue assist device for use with a throwable personal floatation device is provided. The device includes a top handle member, a bottom member including a first coupling feature, and a first side member including a first end and a second end, wherein the first end is connected with the top handle member, and wherein the second end is connected with the bottom member. The device also includes a second side member including a first end and a second end, wherein the first end is connected with the top handle member, and wherein the second end is connected with the bottom member. Further, a first end of a retaining arm is pivotably connected with the first side member, and a second end of the retaining arm includes a second coupling feature that is configured for being releasably engaged with the first coupling feature.

21 Claims, 6 Drawing Sheets

(56) References Cited

U.S. PATENT DOCUMENTS

| | | | | |
|---|---|---|---|---|
| 7,285,032 | B2 * | 10/2007 | Cha | B63C 9/26 441/81 |
| 8,708,762 | B2 * | 4/2014 | Samelian | B63C 9/082 441/81 |
| 9,174,712 | B2 * | 11/2015 | Klotz | B63C 9/082 |
| 2002/0072286 | A1 | 6/2002 | Smith | |
| 2006/0076186 | A1 | 4/2006 | Lindqvist | |

* cited by examiner

TANGLE-FREE RESCUE ASSIST DEVICE

CROSS-REFERENCE TO RELATED APPLICATIONS

This application claims the benefit of U.S. Patent Application No. 62/823,037, filed Mar. 25, 2019, the contents of which are hereby incorporated by reference in its entirety.

FIELD OF THE INVENTION

The present invention is directed to a rescue assist device; in particular, to a rescue assist device that may be used in assisting with a water rescue; and more particularly, to a rescue assist device that is used in association with a floatation device attached to a rope, wherein the rescue assist device maintains, and allows for the release of, the rope in a tangle-free manner during a rescue.

BACKGROUND OF THE INVENTION

Boating and water sports are popular activities during the warmer months. Given that these activities typically occur in large bodies of water, and not everyone is proficient at swimming, there is a risk of injury or death if proper safety standards and protocol are not followed. More than two-thirds of all boating fatalities are drowning incidents, many of which the victim did not have access to a personal flotation device (PFD).

Many water related injuries and fatalities could be avoided if PFD's are either worn by or accessible to the passengers on the boat. The U.S. Coast Guard (USCG) and many state laws require that PFD's, such as a properly fitted life jacket, be available for every person aboard a recreational vessel. Each state may also have additional requirements for persons participating in water related activities such as for water skiing and personal watercraft operation. Further, boats of sixteen feet or greater in length must typically have a throwable PFD onboard.

Throwable PDF's are classified by the USCG as a Type IV device and include ring buoys, horseshow buoys, seat cushions, or other similar devices. These devices are stored in the cockpit or at the helm of the boat so they are available for immediate use in case of an emergency. Typically these devices are attached to a rope so that they can be thrown by a person in the boat to a distressed individual located in the water, the distressed individual grasps the device, and the person in the boat then pulls the distressed person back safely to the boat.

The manner in which the throwable PFD's are stored in a boat sometimes prevents them from being used in a timely manner to assist a person in distress. Many items, including throwable PFD's, that are stored in a boat are located in storage compartments located underneath the boat seats. When a throwable PFD is placed in an under seat storage location, a rope that is attached to it is usually wound around a person's arm and then loosely placed next to the throwable PFD. This leaves the rope vulnerable to being tangled as other items are placed in the same storage locations and as the boat moves during operation. When the rope is tangled, this prohibits the device from being used to its full capability when someone is in distress because it will not be able to be readily thrown the full distance of the length of the rope. If a person in the boat decides to try to untangle the rope prior to throwing the PFD to the person in distress, this delay in time could be the difference between saving or not saving the person in distress.

Accordingly there is a need for a device that allows for the reliable immediate use of a throwable PFD. In particular, there is a need for a device that maintains a rope attached to a throwable PFD in a tangle-free configuration for immediate use. The present invention fills these needs as well as other needs.

SUMMARY OF THE INVENTION

In one aspect, the present invention includes a rescue assist device for use with a throwable personal floatation device. The rescue assist device comprises a top handle member, a bottom member including a first coupling feature, first and second side members, a cross member, and a retaining arm. The first side member includes a first end and a second end, wherein the first end of the first side member is connected with the top handle member, and wherein the second end of the first side member is connected with the bottom member. The second side member includes a first end and a second end, wherein the first end of the second side member is connected with the top handle member, and wherein the second end of the second side member is connected with the bottom member. The cross member is connected to and extends between the first and second side members. The retaining arm includes a first end and a second end, wherein the first end of the retaining arm is pivotably connected with the cross member, wherein the second end of the retaining arm includes a second coupling feature that is configured for being releasably engaged with the first coupling feature.

Further, the cross member may include a first end and a second end, wherein the first end of the cross member is connected with the first side member between the first and second ends of the first side member, and wherein the second end of the cross member is connected with the second side member between the first and second ends of the second side member. Also, a rope having a first end and a second end may be provided with the device. The rope may be wound around the first and second side members in a serpentine configuration. The first end of the rope may be configured for being attached to the throwable PFD, and the second end of the rope may be configured for being attached to a user holding the top handle member.

In another aspect, a rescue assist device for use with a throwable personal floatation device comprises a top handle member, a bottom member including a first coupling feature, first and second side members, and a retaining arm. The first side member includes a first end and a second end, wherein the first end of the first side member is connected with the top handle member, and wherein the second end of the first side member is connected with the bottom member. The second side member includes a first end and a second end, wherein the first end of the second side member is connected with the top handle member, and wherein the second end of the second side member is connected with the bottom member. The retaining arm includes a first end and a second end, wherein the first end of the retaining arm is pivotably connected with the first side member, and wherein the second end of the retaining arm includes a second coupling feature that is configured for being releasably engaged with the first coupling feature. This device may further comprise a rope having a first end and a second end, wherein the rope is wound around the first and second side members in a serpentine configuration. The first end of the rope may be configured for being attached to the throwable personal floatation device, and the second end of the rope may be configured for being attached to a user holding the top handle member.

In yet another aspect, a rescue assist device for use with a throwable personal floatation device may comprise a frame including a first coupling feature, a retaining arm, and a rope. The retaining arm may include a first end and a second end, wherein the first end of the retaining arm is pivotably connected with the first side member, and wherein the second end of the retaining arm includes a second coupling feature that is configured for being releasably engaged with the first coupling feature. The rope has a first end and a second end, wherein the rope is wound around the frame in a serpentine configuration. The first end of the rope may be configured for being attached to the throwable personal floatation device, and the second end of the rope may be configured for being attached to a user holding the frame.

In still another aspect, a rescue assist device for use with a throwable personal floatation device comprises a top handle member, a bottom member having a knob feature extending therefrom, a first side member, and a first stop extending from the first side member. The first side member includes a first end and a second end, wherein the first end of the first side member is connected with the top handle member, and wherein the second end of the first side member is connected with the bottom member. The device further includes a second side member and a second stop member extending from the second side member. The second side member includes a first end and a second end, wherein the first end of the second side member is connected with the top handle member, and wherein the second end of the second side member is connected with the bottom member. The device also may include a rope having a first end and a second end. The rope is wound around the frame in a serpentine configuration between the second ends of the first and second side members and the first and second stops. The first end of the rope may be configured for being selectively positioned around the knob feature and attached to the throwable personal floatation device, and the second end of the rope may be configured for being attached to a user holding the top handle member.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The above-mentioned and other features and advantages of this invention, and the manner of attaining them, will become apparent and be better understood by reference to the following description of the invention in conjunction with the accompanying drawing, wherein.

DETAILED DESCRIPTION OF THE INVENTION

Figure 2:
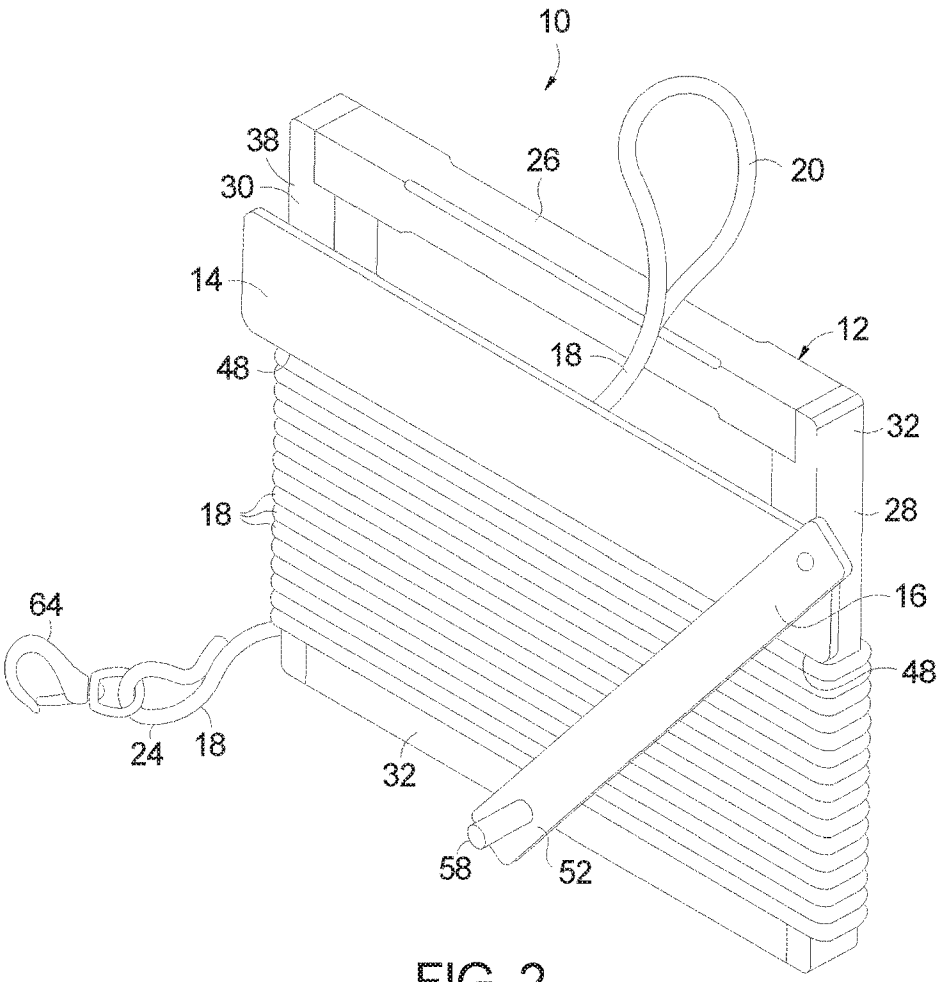
FIG. 2 is a front perspective view of the device shown in FIG. 1 including a rope and hook.
Figure 1:
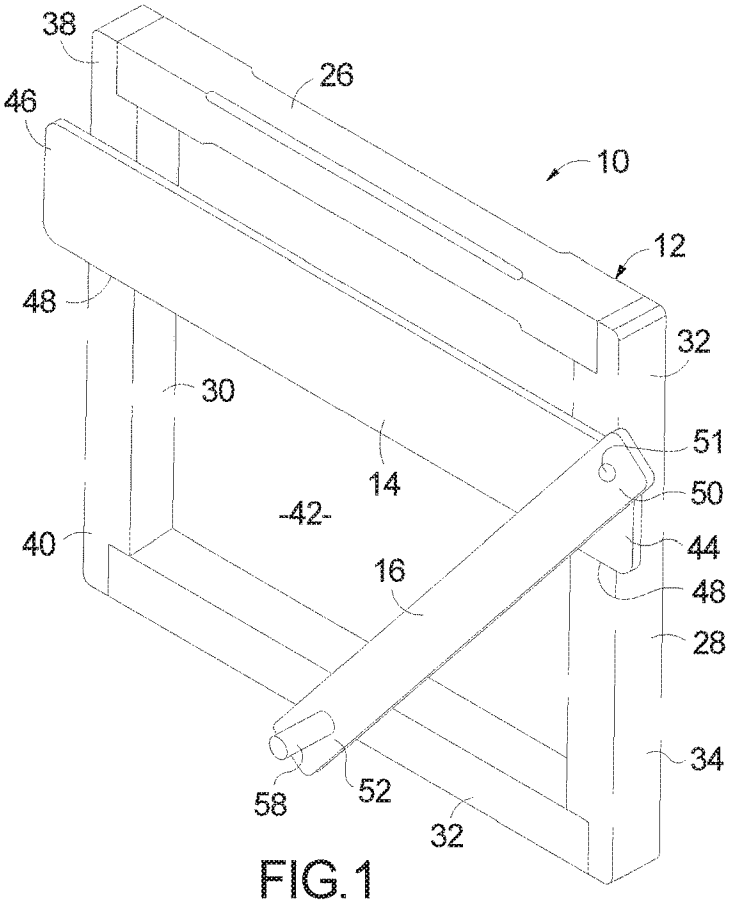
FIG. 1 is a front perspective view of a tangle-free rescue assist device in accordance with one aspect of the present invention.

Referring now to the drawings in detail, and specifically to FIGS. 1-9, reference numeral 10 designates a rescue assist device in accordance with one aspect of the present invention. In general, device 10 may include a frame 12, a cross member 14 extending across a portion of frame 10, and a retaining arm 16 that is adapted to selectively retain a rope 18 that is wound around frame 10. A first end 20 of rope 18 is secured to a user 22 that is holding onto frame 10, while a second end 24 of rope 18 is attached to a throwable personal floatation device (PFD) 25, such as, but not limited to, a ring buoy, horseshow buoy, seat cushion, or other similar device. Device 10 allows for the PFD to be thrown to a person in distress with the rope 18 being unwound from frame 12 in a tangle-free manner.

As best seen in FIGS. 1 and 4-9, frame 12 may include a top handle member 26, opposing side members 28, 30, and a bottom member 32. Top handle member 26 is adapted to allow user 22 to hold device 10. Side member 28 includes a first end 34 that is connected to top handle member 26, and a second end 36 that is connected to bottom member 32. Side member 30 includes a first end 38 that is connected to top handle member 26, and a second end 40 that is connected to bottom member 32. The combination of top handle member 26, opposing side members 28, 30, and bottom member 32 may, for example, be formed as a parallelogram, such as, but not limited to, a square or rectangle. It should be understood by one skilled in the art that frame 10 may also be configured in other shapes so long as rope 18 may be wound around opposing side members 28, 30 in an untangled manner. For instance, rope 18 may be wound around frame 12 in a serpentine fashion from first ends 34, 38 of side members 28, 30 to lower edge 48 of cross member 14, or vice versa. Further, it can be seen that top handle member 26, opposing side members 28, 30, and bottom member 32 define an opening 42. However, it should be understood that the present invention also contemplates that frame 10 be a solid member with no opening 42.

Cross member 14 is connected to and extends between the side members 28, 30. In particular, cross member 14 includes a first end 44 and a second end 46. First end 44 is connected to side member 28 between the first and second ends 34, 36, and second end 46 is connected to side member 30 between the first and second ends 38, 40. Cross member 14 further includes a lower edge 48 that is positioned to serve as an upper stop limit for rope 18 when it is wound on frame 10 so rope 18 does not slide up toward top handle member 26.

Figure 3:
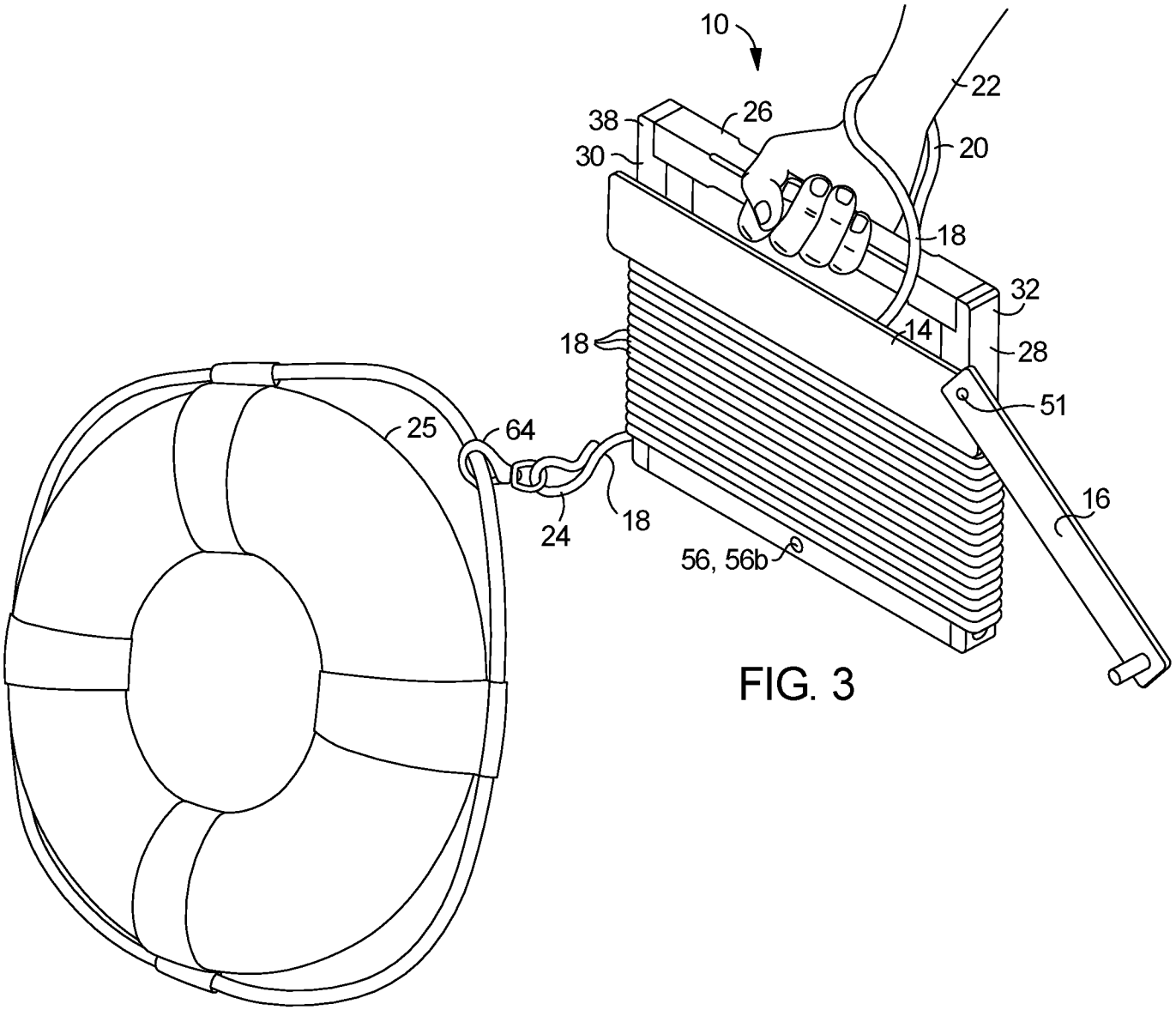
FIG. 3 is a front perspective view of the device shown in FIG. 2 with a user holding onto a top handle member.
Figure 4:
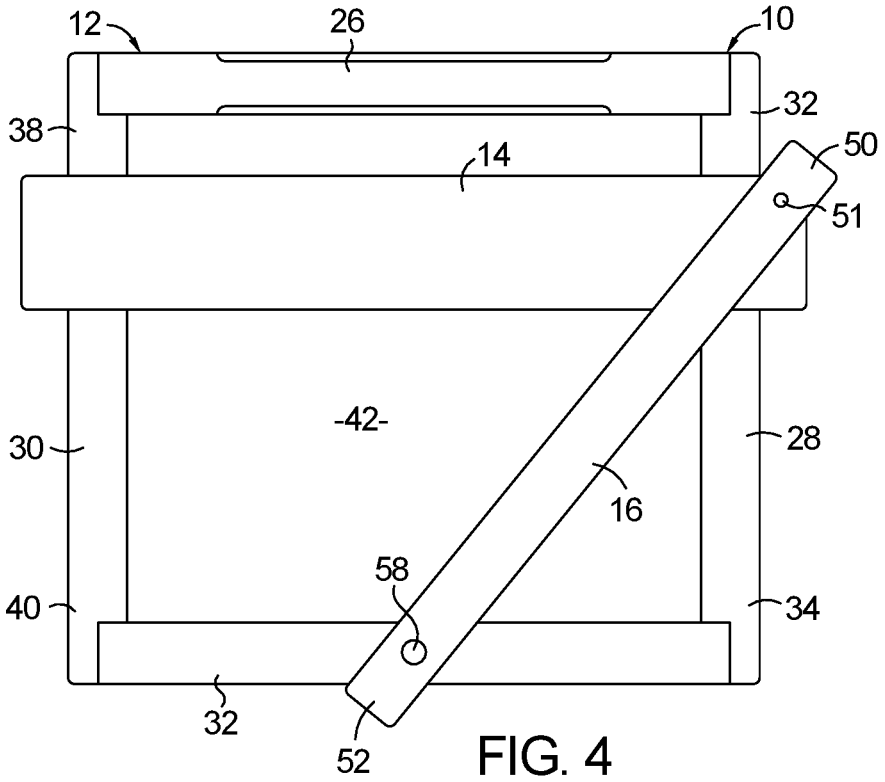
FIG. 4 is a front view of the device shown in FIG. 1.
Figure 5:
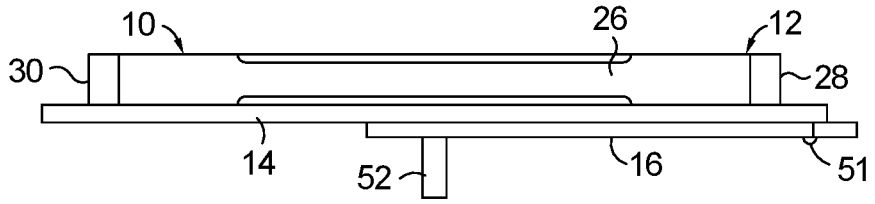
FIG. 5 is a top view of the device shown in FIG. 1.
Figure 6:
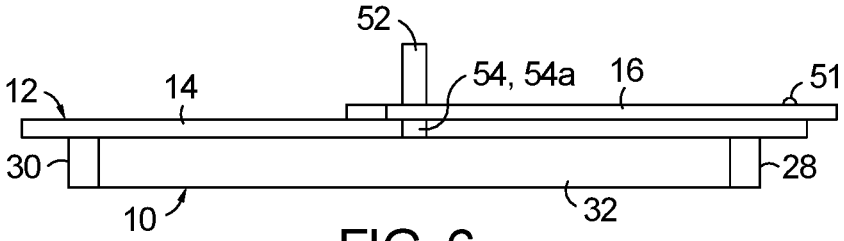
FIG. 6 is a bottom view of the device shown in FIG. 1.
Figure 7:
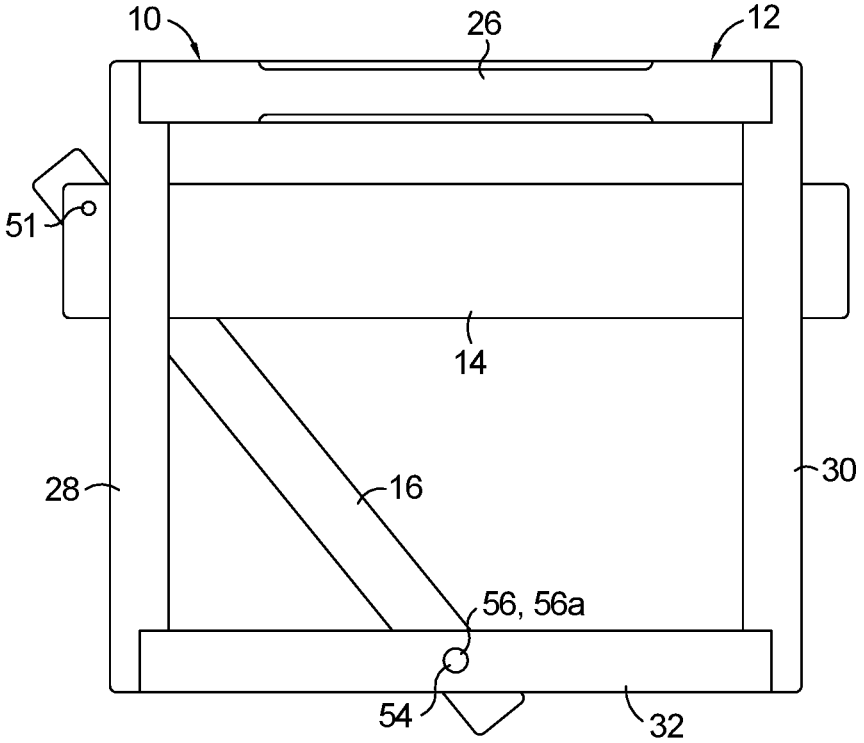
FIG. 7 is a back view of the device shown in FIG. 1.
Figure 8:
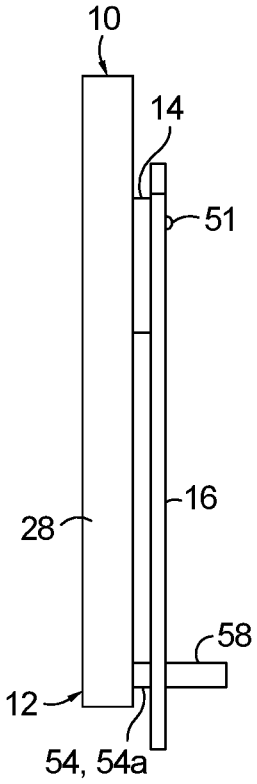
FIG. 8 is a right side view of the device shown in FIG. 1.
Figure 9:
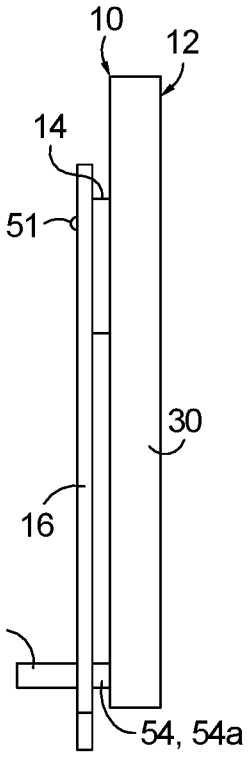
FIG. 9 is a left side view of the device shown in FIG. 1.

Retaining arm 16 is adapted to selectively retain rope 18 that is wound around side members 28, 30. A first end 50 of retaining arm 16 is pivotally connected with cross member 14 at pivot point 51. For example, retaining arm 16 may be pivotally connected to first end 44 of cross member 14. However, it should be understood that retaining arm 16 could be connected along any portion of cross member 14 so long as it can be moved between a closed position (FIG. 1) to retain rope 18 in a wound configuration on frame 10, and an open position (FIG. 3) to allow rope 18 to be unwound during use of device 10. A second end 52 of retaining arm 16 may include a coupling feature 54 (FIGS. 6, 8 and 9) that is configured to be releasably engaged with a corresponding coupling feature 56 on bottom member 32 (FIG. 3). The coupling features 54, 56 are used to allow retaining arm 16 to be selectively maintained in the closed position. For example, coupling feature 56 may be an aperture 56*a* or a recess 56*b* defined in bottom member 32, and coupling feature 54 may be a pin 54*a* that extends from an inner surface of second end 52 of retaining arm 16 which is configured to be positioned in the aperture. Second end 52 of retaining arm 16 may also include a knob portion 58 extending from an outer surface thereof that may serve two functions. The first function is to provide user 22 with a handle for gripping second end 52 of retaining arm 16 when moving retaining arm 16 between closed and opened positions. The second function is to provide a location for second end 24 of rope 18 to be releasably attached so that rope 18 does not have a tendency to unwind from frame 10.

In use, coupling feature 54 is first removed from coupling feature 56 by pulling on knob portion 58, for example, so that retaining arm 16 can be moved from the closed position (FIG. 1) to the opened position. Rope 18 may then be wound around side members 28, 30 in a serpentine fashion, for example, from second ends 36, 40 of side members 28, 30 until rope 18 abuts lower edge 48 of cross member 14. The first end 20 of rope 18 is left with a little slack, off frame 12, to allow it to be looped around a wrist or arm of user 22, while user 22 is holding onto top handle member 26. Retaining arm 16 may then be moved from the opened position to the closed position shown in FIG. 2 using knob portion 58 to maintain rope 18 in the wound position on frame 12. The second end 24 of rope 18 is also left with a little slack so that it can be attached to a PFD (not shown). For example, second end 24 may be looped or otherwise attached to a swivel release hook 64 (FIG. 3) that allows a PFD to be releasably attached to second end 24 of rope 18. Prior to using device 10, second end 24 of rope 18 may be lopped around knob portion 58 so rope 18 does not unwind prematurely. Device 10 is then ready for use and may be stored in a convenient location in case an emergency arises.

When an emergency arises, and a PFD is attached to second end 24 of rope 18, user 22 places first end 20 of rope 18 around his or her wrist and holds onto top handle member 26. Retaining arm 16 is pivoted about pivot axis 51 from the closed position (FIG. 2) to the opened position (FIG. 3) be decoupling coupling features 54, 56. The PFD is then thrown to a person in distress. In throwing the PDF, rope 18 is unwound from frame 12 in an untangled manner to provide for the full use of rope 18. After the person in distress grabs the PFD, device 10 may then be dropped and user 22 can then pull the person back safely to the watercraft by pulling in rope 18. Device 10 may then be reused by re-winding rope 18 back on to frame 12 and placing retaining arm 16 in the closed position.

Figure 10:
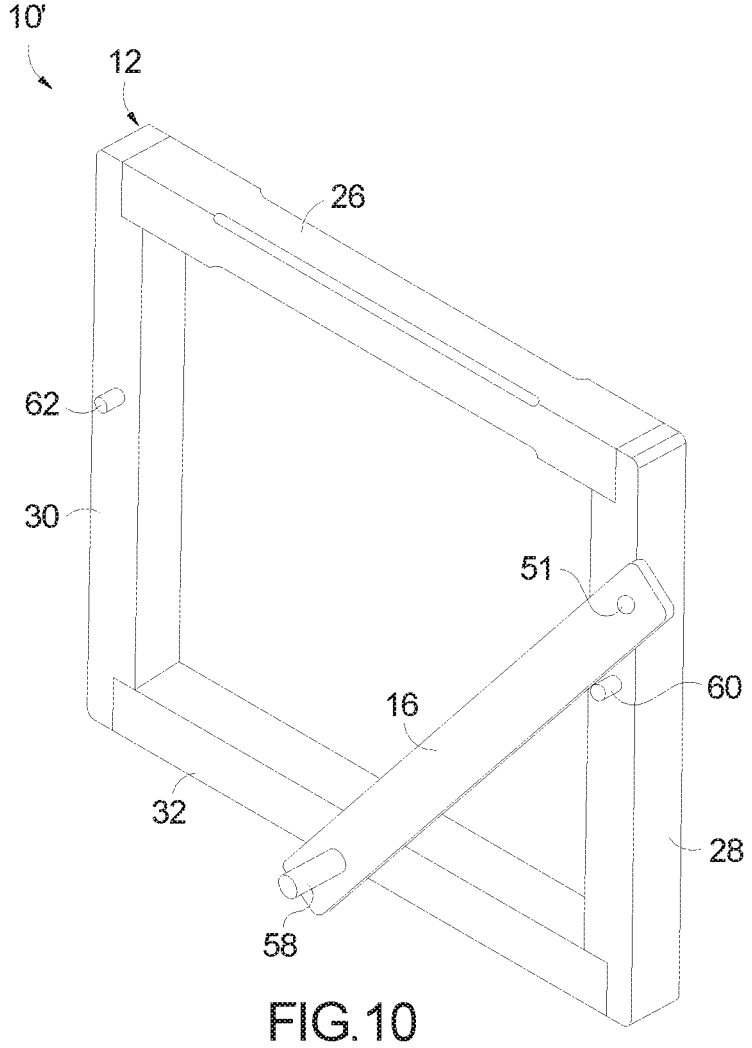
FIG. 10 is a front perspective view of another embodiment of the tangle-free rescue assist device.

Another alternative exemplary device of the present invention is set forth in FIG. 10 and is identified with reference numeral 10'. Many components and aspects of device 10' apply equally to those that were described with respect to device 10 and will not be repeated herein. However, the cross member 14 that was described with respect to device 10 is not included in device 10'. As such, instead of first end 50 of retaining arm 16 being pivotally coupled with cross member 14, first end 50 is pivotally coupled directly to side member 28 at pivot point 51 located between first and second ends 34, 36 of side member 28. Furthermore, device 10' includes at least one stop 60, 62 extending from a respective surface of side members 28, 30 to provide an upper travel limit for rope 18 wound on frame 12. The use of device 10' is similar to that which was described with respect to device 10.

Figure 11:
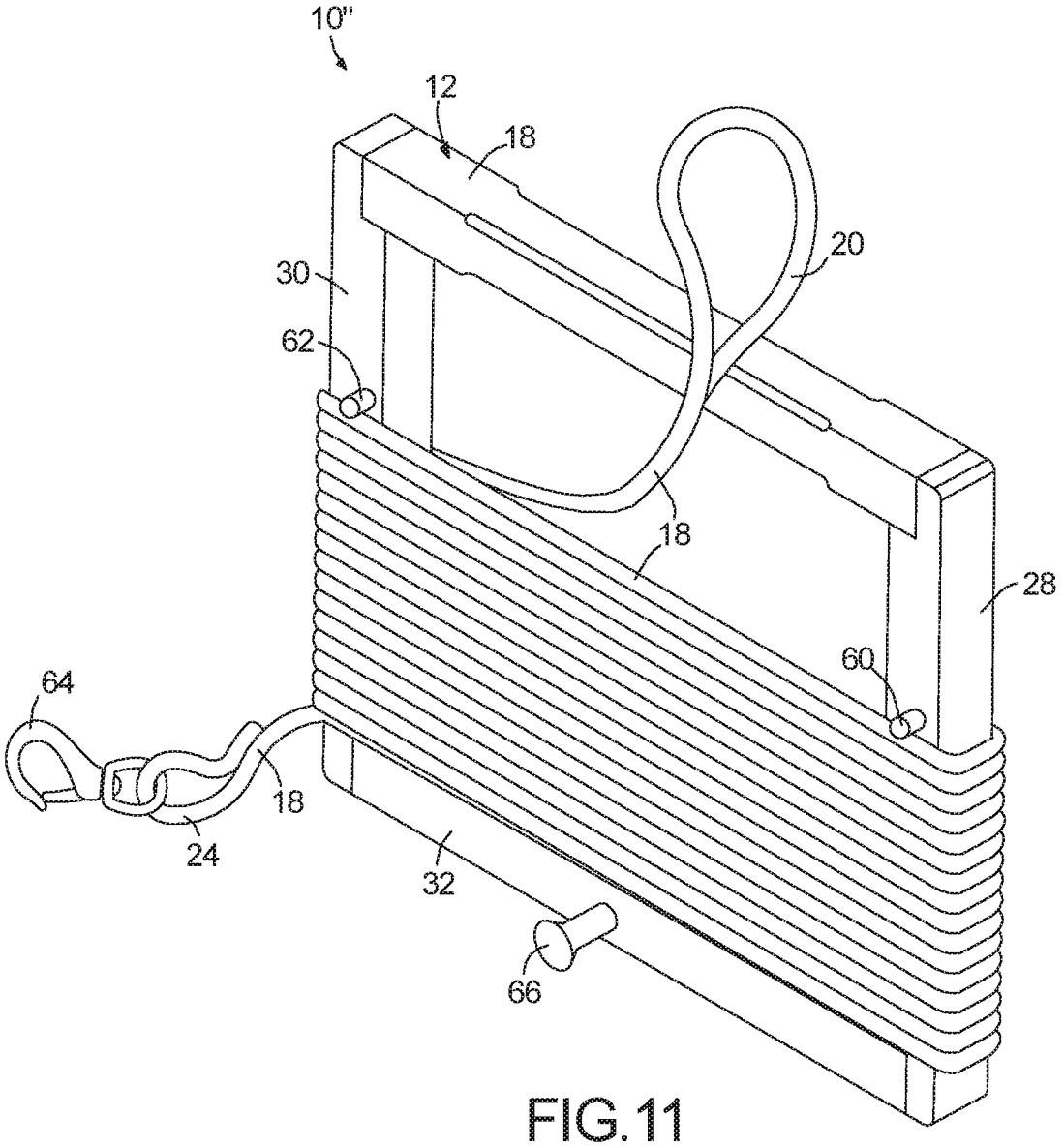
FIG. 11 is a front perspective view of yet another embodiment of the tangle-free rescue assist device.

A further alternative exemplary device of the present invention is set forth in FIG. 11 and is identified with reference numeral 10'''. Device 10" is similar to device 10 in that it includes frame 10, and device 10' in that it includes stops 60, 62 mounted to side members 28, 3. However, unlike devices 10 and 10', device 10" does not include retaining arm 16. Instead, it includes a knob portion 66 that is mounted directly to a surface of bottom member 32 that serves as a location for second end 24 of rope 18 to be looped around in order to maintain rope 18 in a wound position on frame 12.

From the foregoing, it will be seen that this invention is one well adapted to attain all the ends and objects hereinabove set forth together with other advantages which are obvious and which are inherent to the method and apparatus. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. As used herein, the terms "having" and/or "including" and other terms of inclusion are terms indicative of inclusion rather than requirement.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A rescue assist device for use with a throwable personal floatation device, the rescue assist device comprising:

a top handle member;

a bottom member including a first coupling feature;

a first side member including a first end and a second end, wherein the first end of the first side member is connected with the top handle member, and wherein the second end of the first side member is connected with the bottom member;

a second side member including a first end and a second end, wherein the first end of the second side member is connected with the top handle member, and wherein the second end of the second side member is connected with the bottom member;

a cross member connected to and extending between the first and second side members; and a retaining arm including a first end and a second end, wherein the first end of the retaining arm is pivotably connected with the cross member, wherein the second end of the retaining arm includes a second coupling feature that is configured for being releasably engaged with the first coupling feature.

2. A rescue assist device in accordance with claim 1, wherein the cross member includes a first end and a second end, wherein the first end of the cross member is connected with the first side member between the first and second ends of the first side member, and wherein the second end of the cross member is connected with the second side member between the first and second ends of the second side member.

3. A rescue assist device in accordance with claim 2, wherein the first end of the retaining arm is pivotally connected with the first end of the cross member.

4. A rescue assist device in accordance with claim 1, wherein the first coupling feature is a recess defined in the bottom member.

5. A rescue assist device in accordance with claim 4, wherein the second coupling feature is a pin that is configured for being positioned in the recess defined in the bottom member.

6. A rescue assist device in accordance with claim 1, further comprising a knob portion extending from the second end of the retaining arm.

7. A rescue assist device in accordance with claim 1, wherein the top handle member, the bottom member, and the first and second side members form a parallelogram.

8. A rescue assist device in accordance with claim 1, further comprising a rope having a first end and a second end, wherein the rope is wound around the first and second side members in a serpentine configuration, wherein the first end of the rope is configured for being attached to the throwable personal floatation device, and wherein the second end of the rope is configured for being attached to a user holding the top handle member.

9. A rescue assist device for use with a throwable personal floatation device, the rescue assist device comprising:

a top handle member;

a bottom member including a first coupling feature;

a first side member including a first end and a second end, wherein the first end of the first side member is connected with the top handle member, and wherein the second end of the first side member is connected with the bottom member;

a second side member including a first end and a second end, wherein the first end of the second side member is connected with the top handle member, and wherein the second end of the second side member is connected with the bottom member; and a retaining arm including a first end and a second end, wherein the first end of the retaining arm is pivotably connected with the first side member, and wherein the second end of the retaining arm includes a second coupling feature that is configured for being releasably engaged with the first coupling feature.

10. A rescue assist device in accordance with claim 9, wherein the retaining arm is pivotably connected with the first side member between the first and second ends of the first side member.

11. A rescue assist device in accordance with claim 9, wherein the first coupling feature is a recess defined in the bottom member.

12. A rescue assist device in accordance with claim 11, wherein the second coupling feature is a pin that is configured for being positioned in the recess defined in the bottom member.

13. A rescue assist device in accordance with claim 9, further comprising a knob portion extending from the second end of the retaining arm.

14. A rescue assist device in accordance with claim 9, wherein the top handle member, the bottom member, and the first and second side members form a parallelogram.

15. A rescue assist device in accordance with claim 9, further comprising a rope having a first end and a second end, wherein the rope is wound around the first and second side members in a serpentine configuration, wherein the first end of the rope is configured for being attached to the throwable personal floatation device, and wherein the second end of the rope is configured for being attached to a user holding the top handle member.

16. A rescue assist device in accordance with claim 9, further comprising a first stop extending from at least one of the first side member or the second side member.

17. A rescue assist device in accordance with claim 16, further comprising a second stop extending from the other of the first side member or the second side member.

18. A rescue assist device for use with a throwable personal floatation device, the rescue assist device comprising:

a frame including a first coupling feature;

a retaining arm including a first end and a second end, wherein the first end of the retaining arm is pivotably connected with the frame, and wherein the second end of the retaining arm includes a second coupling feature that is configured for being releasably engaged with the first coupling feature; and a rope having a first end and a second end, wherein the rope is wound around the frame in a serpentine configuration, wherein the first end of the rope is configured for being attached to the throwable personal floatation device, and wherein the second end of the rope is configured for being attached to a user holding the frame.

19. A rescue assist device in accordance with claim 18, wherein the first coupling feature is a recess defined in the frame, and wherein the second coupling feature is a pin that is configured for being positioned in the recess defined in the frame.

20. A rescue assist device for use with a throwable personal floatation device, the rescue assist device comprising:

a top handle member;

a bottom member having a knob feature extending therefrom;

a first side member including a first end and a second end, wherein the first end of the first side member is connected with the top handle member, and wherein the second end of the first side member is connected with the bottom member;

a first stop extending from the first side member;

a second side member including a first end and a second end, wherein the first end of the second side member is connected with the top handle member, and wherein the second end of the second side member is connected with the bottom member;

a second stop extending from the second side member; and a rope having a first end and a second end, wherein the rope is wound around the frame in a serpentine configuration between the second ends of the first and second side members and the first and second stops, wherein the first end of the rope is configured for being selectively positioned around the knob feature and attached to the throwable personal floatation device, and wherein the second end of the rope is configured for being attached to a user holding the top handle member.

21. A rescue assist device for use with a throwable personal floatation device, the rescue assist device comprising:

a frame;

a retaining arm including a first end and a second end, wherein the first end of the retaining arm is pivotably connected with the frame, and wherein the second end of the retaining arm is configured for being releasably engaged with the frame; and a rope having a first end and a second end, wherein the rope is wound around the frame, wherein the first end of the rope is configured for being attached to the throwable personal floatation device, and wherein the second end of the rope is configured for being attached to a user holding the frame.

* * * * *